US009476248B2

(12) United States Patent
Smart et al.

(10) Patent No.: US 9,476,248 B2
(45) Date of Patent: Oct. 25, 2016

(54) MOVABLE PARTITION SYSTEMS INCLUDING HEADER ASSEMBLIES AND RELATED METHODS

(75) Inventors: R. Scott Smart, Sandy, UT (US); Ivan W. Stewart, Herriman, UT (US)

(73) Assignee: Won-Door Corporation, Salt Lake City, UT (US)

( * ) Notice: Subject to any disclaimer, the term of this patent is extended or adjusted under 35 U.S.C. 154(b) by 582 days.

(21) Appl. No.: 13/305,480

(22) Filed: Nov. 28, 2011

(65) Prior Publication Data

US 2013/0133844 A1 May 30, 2013

(51) Int. Cl.
*E05D 15/06* (2006.01)
*E06B 3/94* (2006.01)

(52) U.S. Cl.
CPC ..... *E06B 3/94* (2013.01); *E05D 15/063* (2013.01); *E05Y 2600/626* (2013.01); *E05Y 2600/628* (2013.01); *E05Y 2800/416* (2013.01); *E05Y 2900/134* (2013.01); *E05Y 2900/142* (2013.01)

(58) Field of Classification Search
CPC ..... A47H 1/104; A47H 15/00; A47H 15/02; A47H 15/04; E05D 15/00; E05D 15/26; E05D 15/0621; E05D 15/06; E05D 15/04; E05D 15/0626; E06B 3/481; E06B 5/16; E06B 5/164; E06B 3/94; E05Y 2600/626; E05Y 2800/416; E05Y 2900/134; E05Y 2900/142
USPC .... 160/199, 201, 206, 126; 16/87 R, 87.4 R; 52/243.1, 745.15, 241, 238.1
See application file for complete search history.

(56) References Cited

U.S. PATENT DOCUMENTS 2,904,848 A * 9/1959 Lieberenz ..... E05D 15/0652 16/94 R
2,909,802 A 10/1959 Gang et al.
2,945,535 A 7/1960 Haws
(Continued)

FOREIGN PATENT DOCUMENTS

JP 07-150676 6/1995
KR 10-2010-0107702 10/2010

OTHER PUBLICATIONS

Garrett III, et al., Title "Movable Partition Systems and Header Structures and Components Thereof, and Related Methods of Installation," U.S. Appl. No. 13/183,250, filed Jul. 14, 2011.
(Continued)

*Primary Examiner* — Syed A Islam
*Assistant Examiner* — Jeremy Ramsey
(74) *Attorney, Agent, or Firm* — TraskBritt

(57) ABSTRACT

Header assemblies for movable partitions comprise an overhead track. A header pan is configured to abut against and be secured to the overhead track and comprises at least two header pan members defining opposing lateral portions of the header pan. The header pan is configured to form at least a portion of a fire-resistant barrier. Methods of forming fire-resistant header assemblies comprise forming a first header pan member to define a first lateral portion of a header pan. A second header pan member is formed to define a second, opposing lateral portion of the header pan. The header pan is configured to extend laterally across a header space between a wall of an adjoining structure and an opposing wall of the adjoining structure and to at least substantially longitudinally occlude the header space when the first and second header pan members jointly form the header pan.

17 Claims, 8 Drawing Sheets

(56) References Cited

U.S. PATENT DOCUMENTS

| | | | | |
|---|---|---|---|---|
| 3,346,909 | A * | 10/1967 | Blackburn | 16/94 D |
| 3,529,651 | A | 9/1970 | Bender | |
| 3,685,235 | A | 8/1972 | Lang | |
| 3,755,968 | A | 9/1973 | Williams | |
| 3,878,583 | A * | 4/1975 | Smart | 16/95 R |
| 4,011,696 | A * | 3/1977 | Klein | 52/39 |
| 4,133,364 | A | 1/1979 | Smart | |
| 4,281,481 | A | 8/1981 | Wendt | |
| 4,674,248 | A | 6/1987 | Hall | |
| 5,167,575 | A | 12/1992 | MacDonald | |
| 5,377,463 | A * | 1/1995 | Howe | G09F 7/18 52/200 |
| 5,411,072 | A | 5/1995 | Starck et al. | |
| 5,481,834 | A | 1/1996 | Kowalczyk et al. | |
| 5,697,131 | A | 12/1997 | Hunt et al. | |
| 6,615,894 | B1 * | 9/2003 | McKeon | 160/1 |
| 6,955,010 | B2 * | 10/2005 | Martin | E04D 13/152 52/58 |
| 7,478,663 | B2 | 1/2009 | Goodman et al. | |
| 7,513,293 | B2 | 4/2009 | Goodman et al. | |
| 7,740,046 | B2 | 6/2010 | Goodman et al. | |
| 7,845,385 | B2 | 12/2010 | Goodman et al. | |
| 7,845,386 | B2 | 12/2010 | Coleman et al. | |
| 7,854,248 | B2 | 12/2010 | Coleman et al. | |
| 8,316,914 | B2 * | 11/2012 | Bell | E05D 15/0652 16/95 R |
| 2008/0023152 | A1 | 1/2008 | Goodman et al. | |
| 2008/0209827 | A1 | 9/2008 | Webb | |
| 2008/0264578 | A1 | 10/2008 | Goodman et al. | |
| 2009/0120595 | A1 | 5/2009 | Goodman et al. | |
| 2010/0299889 | A1 * | 12/2010 | George | 24/457 |
| 2011/0024061 | A1 | 2/2011 | Bell et al. | |
| 2011/0036509 | A1 * | 2/2011 | Goodman et al. | 160/7 |
| 2011/0054061 | A1 | 3/2011 | Itano et al. | |
| 2011/0093095 | A1 | 4/2011 | Goodman et al. | |
| 2013/0014907 | A1 | 1/2013 | Garrett, III et al. | |

OTHER PUBLICATIONS

PCT International Search Report and Written Opinion of the International Searching Authority for PCT/US2012/065110, dated Jan. 31, 2013, 10 pages.

International Preliminary Report on Patentability for Application No. PCT/US2012/065110, dated Jun. 3, 2014, 9 pages.

Underwriters Laboratories Inc. (UL), "UL Standard for Safety for Fire Tests of Door Assemblies, UL 10B", Tenth Edition, Dated Feb. 7, 2008, 28 pages.

* cited by examiner

MOVABLE PARTITION SYSTEMS INCLUDING HEADER ASSEMBLIES AND RELATED METHODS

CROSS-REFERENCE TO RELATED APPLICATION

The subject matter of this application is related to the subject matter of U.S. patent application Ser. No. 12/477,056, filed Jun. 2, 2009, now U.S. Pat. No. 8,051,616, issued Nov. 8, 2011, the disclosure of which is incorporated herein in its entirety by this reference.

FIELD

Embodiments of the disclosure relate generally to header assemblies for movable partitions, movable partition systems including header assemblies, and methods of forming and installing movable partitions and header assemblies. More specifically, embodiments of the disclosure relate to header assemblies including a header pan formed from at least two members.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions are utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security and a fire barrier. In such cases, the partition barrier may be configured to automatically close upon the occurrence of a predetermined event such as the actuation of an associated alarm. For example, one or more accordion-type folding or otherwise extending movable partitions may be used as a security barrier, a fire barrier, or both a security and a fire barrier wherein each partition is formed with panels connected to one another with hinges. The hinged connection of the panels allows the partition to fold and collapse into a compact unit for purposes of storage when not deployed. The partition may be stored in a pocket formed in a wall of a building when in a retracted or folded state. When the partition is deployed to subdivide a single large room into multiple smaller rooms, secure an area during a fire, or for any other specified reason, the partition may be extended along an overhead track, which is often located above the door in a header assembly, until the partition extends a desired distance across the room.

In some applications, the header assembly may provide structural support for the overhead track, the movable partition, and a motor. In fire barrier applications, it may be necessary that the movable partition and the header assembly of the partition provide a degree of resistance to fire. Generally, a fire barrier system or assembly provides a barrier to fire, smoke, and heat. Thus, a fire barrier may retard or resist the deleterious effects of fire, smoke, and heat for a certain period of time. A number of standardized tests that evaluate the effectiveness of fire barrier assemblies have been developed for use in the building industry. These are published, for example, in the Uniform Building Code (UBC), the International Building Code (IBC), and by the National Fire Protection Association (NFPA), UNDERWRITERS LABORATORIES® (UL), and the American Society for Testing and Materials (ASTM), among others. Various agencies test fire barriers using these standardized tests, and assign ratings to fire barriers that indicate their effectiveness at slowing the progress of a fire. Barrier testing agencies include Intertek Testing Services, UNDERWRITERS LABORATORIES®, Chiltern International Fire, Ltd., and Warrington Fire Research, among others. Ratings of fire barrier assemblies are generally provided in minutes, and typically vary from 20 minutes to 180 minutes. Examples of fire barrier assembly standards and testing methods can be found in UNDERWRITERS LABORATORIES® UL 10B document titled, "UL Standard for Safety Fire Tests of Door Assemblies."

To provide a fire barrier, the header assembly along with the movable partition and surrounding walls must also provide some level of fire resistance in addition to the movable partition. Thus, when the partition is employed as a fire barrier, it is known to attach the movable partition to a header structure that is configured to provide resistance to fire. FIG. 1 illustrates an example of a conventional fire-resistant header assembly. A header assembly 10 is provided in a header space 12 formed between two fire rated walls 14, which include an opening for the movable partition (not shown). The header assembly 10 includes rods 16 extending from a structural support 18 provided above the two fire rated walls 14. The rods 16 extend from the structural support 18 to a location proximate an overhead track 20 provided for the movable partition. Layers of plywood 22 are attached to the rods 16 extending from the support structure 18. The layers of plywood 22 are typically custom fitted onsite during installation of the movable partition and extend longitudinally along the length of the movable partition and the overhead track 20. The layers of plywood 22 also extend laterally across the header space 12 to the two fire rated walls 14. Layers of gypsum board 24 are provided between the overhead track 20 and the layers of plywood 22. The layers of gypsum board 24 also extend longitudinally along the length of the movable partition and the overhead track 20 and extend laterally across the header space 12 to the two fire rated walls 14. Some of the layers of gypsum board 24 extend only partially across the header space 12 in a lateral direction in order to provide a pocket for the overhead track 20. That is, some layers of gypsum board 24 extend longitudinally along a lateral side of the overhead track 20 and extend laterally between a lateral side of the overhead track 20 and one of the two fire rated walls 14. The layers of gypsum board 24 (together with the layers of plywood 22 and the overhead track 20) provide a fire-resistant barrier extending across the header space 12.

BRIEF SUMMARY

In some embodiments, header assemblies for movable partitions comprise an overhead track. A header pan is configured to abut against and be secured to the overhead track and comprises at least two header pan members defining opposing lateral portions of the header pan. At least one of the overhead track and the header pan is configured to form a fire-resistant barrier extending from a wall of an adjoining structure to an opposing wall of the adjoining structure.

In additional embodiments, movable partition systems comprise the header assembly as set forth in the preceding description of some embodiments. A movable partition comprising at least one structure of hingedly connected panels is suspended from the overhead track.

In yet additional embodiments, methods of forming fire-resistant header assemblies for movable partitions comprise forming a first header pan member to define a first lateral portion of a header pan. A second header pan member is formed to define a second, opposing lateral portion of the header pan. The header pan is configured to extend laterally across a header space between a wall of an adjoining structure and an opposing wall of the adjoining structure and to at least substantially longitudinally occlude the header space when the first and second header pan members jointly form the header pan.

In yet additional embodiments, methods of installing movable partitions comprise forming a header pan. A first header pan member and a second header pan member are combined to jointly form the header pan. An overhead track is coupled from an adjoining structure. A header pan extending laterally across a header space between a wall of the adjoining structure and an opposing wall of the adjoining structure is formed. Formation of the header pan comprises abutting the overhead track with a first lateral portion of the header pan extending from the overhead track toward the wall of the adjoining structure. The overhead track is abutted with a second lateral portion of the header pan extending from the overhead track toward the opposing wall of the adjoining structure. A movable partition comprising at least one structure of hingedly connected panels is suspended from the overhead track.

BRIEF DESCRIPTION OF THE DRAWINGS

While the specification concludes with claims particularly pointing out and distinctly claiming what are regarded embodiments of the present disclosure, various features and advantages of disclosed embodiments may be more readily ascertained from the following description of some example embodiments when read in conjunction with the accompanying drawings, in which:

DETAILED DESCRIPTION

The illustrations presented herein are not meant to be actual views of any particular striker, movable partition system, or component thereof, but are merely idealized representations that are employed to describe example embodiments. Thus, the drawings are not necessarily to scale and relative dimensions may have been exaggerated or diminished for the sake of clarity. Additionally, elements common between figures may retain the same or similar numerical designation.

Embodiments of the disclosure relate to header assemblies including a header pan formed from at least two members defining opposing lateral portions of the header pan. More specifically, disclosed embodiments relate to header pans that are easier and safer to install and simpler to make at least in part because of the reduced weight and complexity of the individual components of the header pans.

As used herein, the term "longitudinal" refers to a direction parallel to a direction of intended motion of a movable partition. Similarly, the term "lateral," as used herein, refers to a direction perpendicular to a direction of intended motion of the movable partition.

Figure 2:
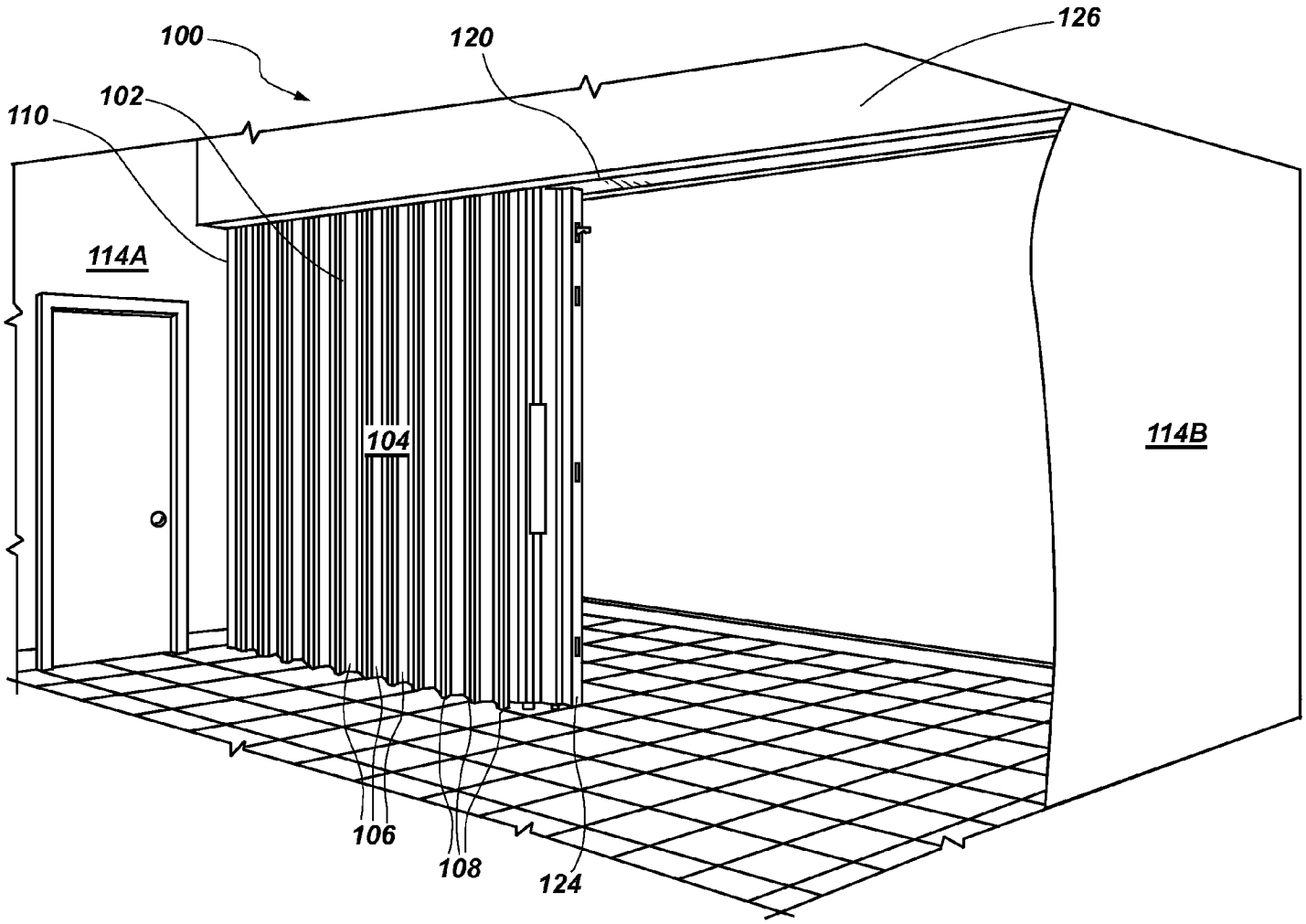
FIG. 2 is a perspective view of a movable partition system.

Referring to FIG. 2, a perspective view of a movable partition system 100 is shown. The movable partition system 100 includes a movable partition 102 in the form of an accordion-type folding door. The movable partition 102 may be used as a barrier (e.g., a security barrier, a fire barrier, or both). As used herein, the term "fire barrier" or "fire resistant" means any material, structure, or element configured to provide a barrier to fire, smoke, heat, or combinations or fire, smoke, and heat or configured to retard or resist the deleterious effects of such for a certain period of time. In other embodiments, the movable partition 102 may be used, for example, to subdivide a relatively larger space into relatively smaller spaces (e.g., rooms or areas). The movable partition 102 may include at least one structure of hingedly connected panels 104 formed from a plurality of panels 106 that are connected to one another with hinges or other hinge-like members 108 to form a pleated (i.e., plicated) structure. The movable partition 102 is engaged with (e.g., suspended from) an overhead track 120 along which the movable partition 102 moves as the movable partition 102 is extended (i.e., closed) and retracted (i.e., opened). The hinged connection of the panels 106 enables the movable partition 102 to be compactly stored in a pocket 110 formed in a wall 114A of a building when in a retracted or folded state.

To deploy the movable partition 102 to an extended position, the movable partition 102 is moved along the overhead track 120. A leading end of the movable partition 102 may include a lead post 124 configured to engage with a door jamb or another post, which may be provided in a wall 114B of a building to which the movable partition 102 may extend in an extended state. While the embodiment of the movable partition 102 shown and described with reference to FIG. 2 contains a single accordion-type door, additional embodiments of the present disclosure may include multiple doors. For example, a partition may include two doors (e.g., accordion-type doors) configured to extend across a space and join together to partition a space, commonly known as a bi-part configuration.

The movable partition system 100 also includes a header structure 126. The header structure 126 includes a structural support member 118 and a header assembly 111, as discussed in further detail with reference to FIGS. 3 through 5. The movable partition 102 may be suspended from and supported by the header structure 126. In other embodiments, the movable partition 102 may be supported by the floor below the movable partition 102, and the header structure 126 may simply serve as a guide for the movable partition 102. While the embodiment of the header structure 126 shown and described with reference to FIG. 2 protrudes into the space where the movable partition 102 is located, the header structure 126 may be partially or entirely located in an overhead structure in additional embodiments. For example, the header structure 126 may not protrude into the space where the movable partition 102 is located, but rather, may be located in an overhead structure such that the overhead track 120 is mounted generally flush with the ceiling of the space.

Figure 1:
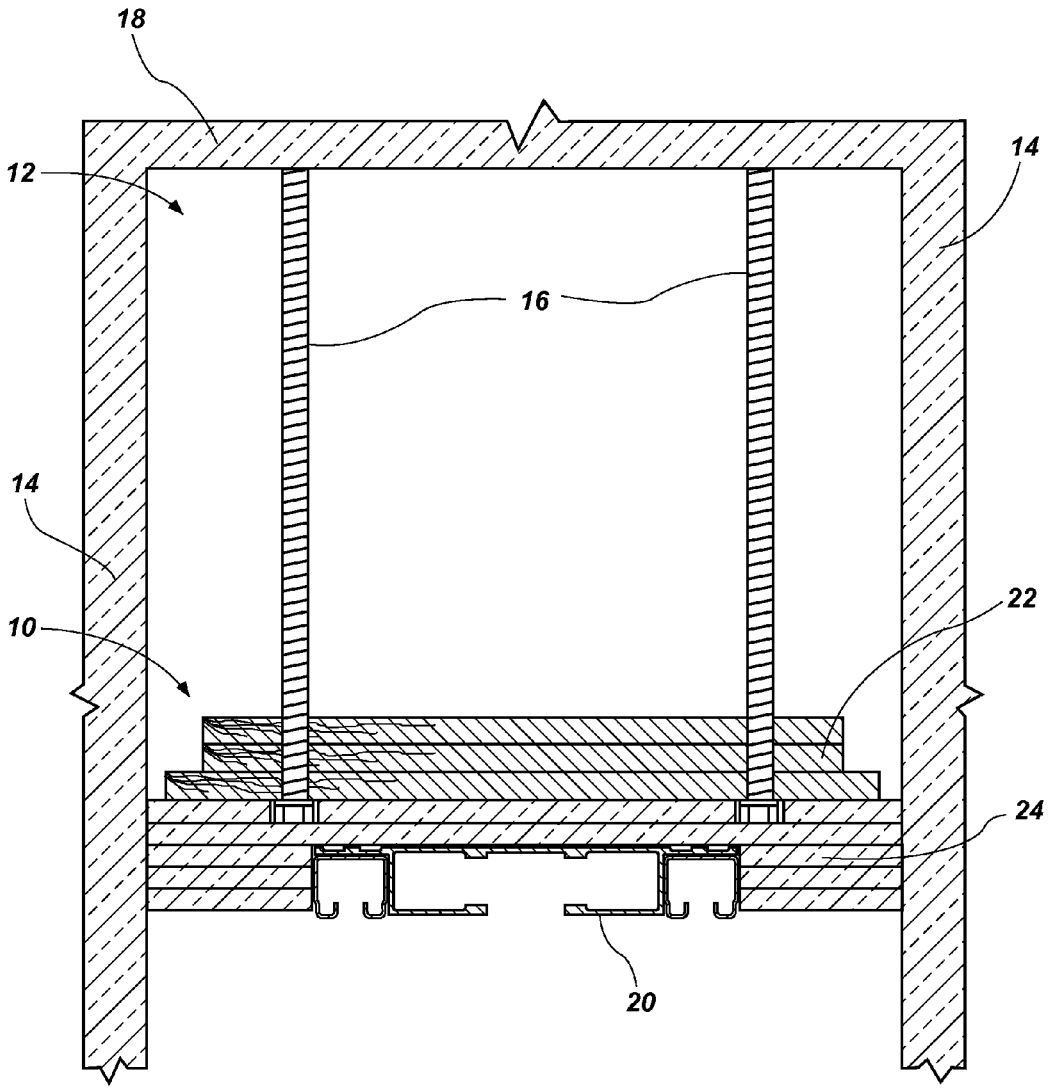
FIG. 1 (PRIOR ART)
FIG. 1 is a partial cross-sectional view of a prior art header assembly for a movable partition.
Figure 3:
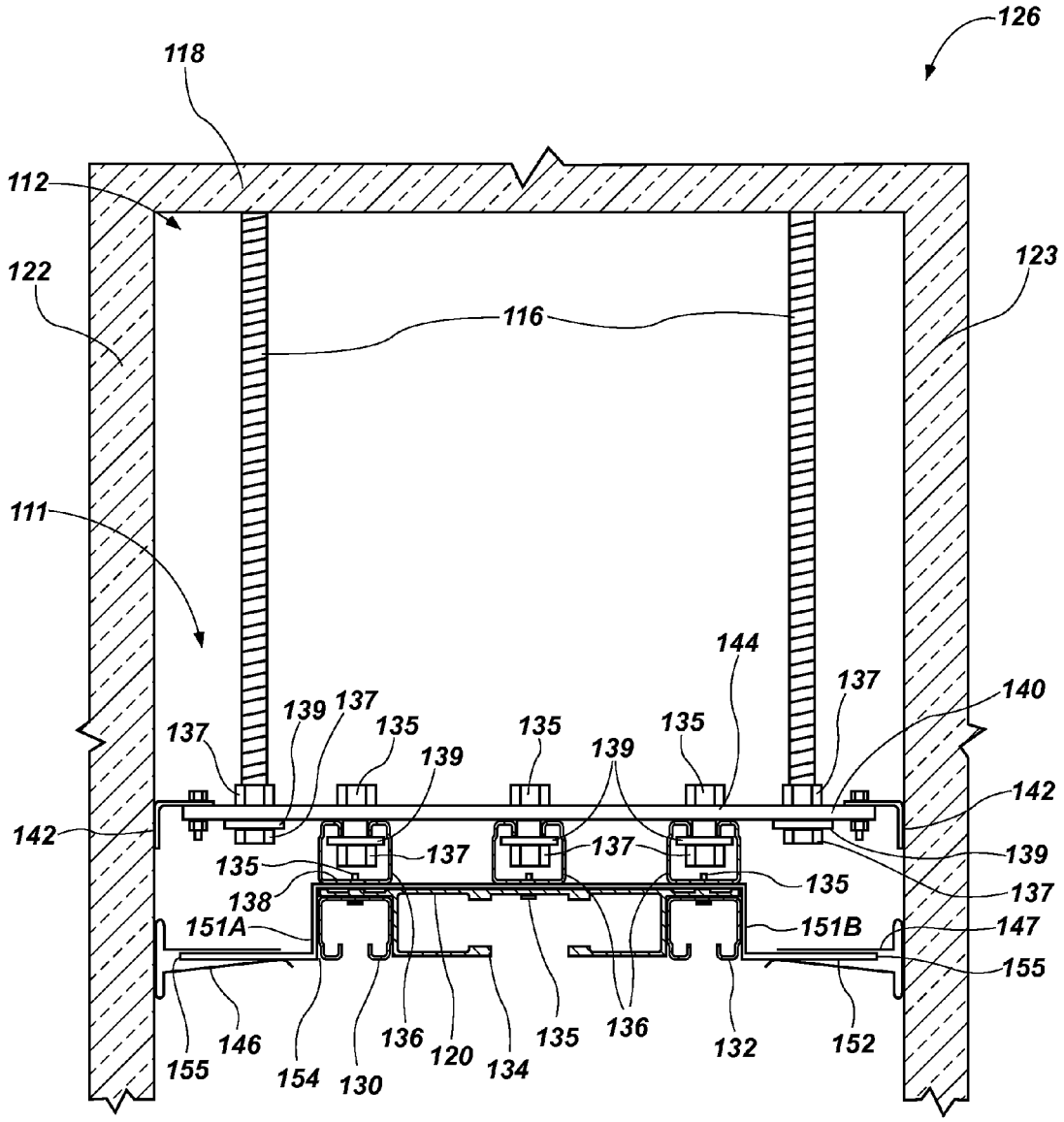
FIG. 3 is a partial cross-sectional view of a header assembly of the movable partition system of FIG. 2.

Referring to FIG. 3, a partial cross-sectional view of the header structure 126 of the movable partition system 100 of FIG. 2 is shown. The header structure 126 includes a header assembly 111 located at least partially within a header space 112 in the header structure 126. The header space 112 may be similar to the header space 12 shown in FIG. 1 and may be provided between a first wall 122, a second, opposing wall 123, and an overhead support member 118. In some embodiments where the movable partition system 100 is implemented as a fire barrier, the first and second walls 122 and 123, respectively, may be formed from a fire-resistant material. It is noted that while the embodiment of FIG. 3 illustrates a header assembly 111 located within a header structure 126, the current disclosure is not so limited. The header structure 126 may not be located in a header recess, but rather, may be located in any suitable location or may be mounted directly to an overhead support structure.

In some embodiments, the header assembly 111 may include an overhead track 120. The overhead track 120 may include, for example, a first channel 130 and a second channel 132. The first channel 130 may be configured for receipt of slide mechanisms or rollers that may be attached to individual panels 106 (see FIG. 2) associated with a first side of a movable partition 102, while a second channel 132 may be configured for receipt of similar slide mechanisms or rollers associated with individual panels 104 associated with a second side of the movable partition 102. The overhead track 120 may further include a central channel 134 that may be disposed between the first and second channels 130 and 132. The central channel 134 may be configured for receipt of a trolley therein, may provide a raceway for a belt or chain, or both.

The overhead track 120 may be supported by the overhead support member 118. For example, attachment hardware 135, such as, for example, bolts and nuts, wood screws, sheet metal screws, or machine screws, may connect the overhead track 120 to structural elements 136 located above the overhead track 120. The structural elements 136 may comprise, for example, metal members extending along a longitudinal length of the movable partition 102 (see FIG. 2) and defining a channel 138, such as a "U" shaped channel 138, in the metal members of the structural elements 136. As a specific, non-limiting example, the structural elements 136 may comprise strut channels, such as, for example, those available from UNISTRUT® Corporation of Wayne, Mich. The structural elements 136 may extend in sections or continuously along the length of the overhead track 120 to support the overhead track 120 and the movable partition 102 (FIG. 2). The attachment hardware 135 may extend upwardly through holes in upper surfaces of the overhead track 120 defining the first and second channels 130 and 132, through a lower surface of the structural elements 136, into the channel 138. The structural elements 136 may be attached to and suspended from a cross brace 140.

Fastener elements such as rods 116 may connect the cross brace 140 to the overhead support member 118. For example, one end of each of the rods 116 may be attached to the overhead support member 118. In some embodiments, the rods 116 may be threaded and may be anchored to the overhead support member 118. The rods 116 may be coupled or fastened to the overhead support member 118 by any suitable manner such as, for example, using conventional nuts. More specifically, each rod 116 may comprise a threaded rod that extends through the cross brace 140, and a nut (not shown) may be threaded onto the end of each rod 116 on a side of the overhead support member 118 opposing the header space 112 to retain the rod 116 in position relative to the overhead support member 118. The overhead support member 118 may be, for example, a wood or metal beam, a truss structure, floor joists, etc. The rods 116 extend from the overhead support member 118 to support the cross brace 140, which, in turn, supports the structural elements 136. For example, the ends of the rods 116 opposite the overhead support member 118 may extend through the cross brace 140, and nuts 137 and washers 139 may be used to suspend the cross brace 140 from the rods 116. Attachment hardware 135, such as, for example, bolts, may extend through the cross brace 140 and into the channels 138 defined by the structural elements 136, and nuts 137 and washers 139 may be used to suspend the structural elements 136 from the cross brace 140. Finally, the overhead track 120 may be suspended from the structural elements 136, as described previously. In this way, the overhead track 120 may be supported from the overhead support member 118.

In some embodiments, the rods 116 may be located at set distances along the longitudinal length of the overhead track 120 to attach the structural elements 136 to the overhead support member 118. For example, the rods 116 may be spaced at set intervals along the overhead track 120, each interval being spaced a set distance, such as 18 in (45.72 cm) apart. Further, in some embodiments, when the movable partition 102 is retracted (i.e., opened), the weight of the movable partition 102 will be concentrated in the area of the overhead track 120 located above the retracted movable partition 102 (e.g., the section of the overhead track 120 located in the pocket 110). Therefore, the rods 116 may be spaced at shorter intervals, such as 12 in (30.48 cm), in the area where the movable partition 102 is stored in a retracted state. It is noted that while the structural elements 136 of FIG. 3 are shown suspended from the overhead support member 118 by the rods 116 and the cross brace 140, the structural elements 136 may be attached, suspended, or spaced from the overhead support member 118 by any suitable manner including, but not limited to, attaching the structural elements 136 directly to the overhead support member 118 or attaching the structural elements 136 to an intermediate support member (not shown) attached to the rods 116.

The cross brace 140 may be sized and configured to maintain the ends of the rods 116 remote from the overhead support member 118 in an intended lateral position. In other words, the rods 116 may be susceptible to lateral deflection, and the cross brace 140 may be used to prevent the rods 116 from deflecting laterally in any significant manner. In some embodiments, the cross brace 140 may extend laterally across the header space 112 from the first wall 122 to the second, opposing wall 123, such that the cross brace 140 abuts against each of the first wall 122 and the second, opposing wall 123. The cross brace 140 may include vertically extending flanges 142 positioned on the sides of the cross brace 140. The flange 142 on one side of the cross brace 140 may abut against the first wall 122, and the flange 142 on an opposite side of the cross brace 140 may abut against the second, opposing wall 123. In such an embodiment, the flanges 142 may be used to secure the cross brace 140 in lateral position against the walls 122 and 123 of the header structure 126. The flanges 142 may be physically attached to the walls 122 and 123 using attachment hardware 135 in some embodiments. In other embodiments, the flanges 142 may not be physically attached to the walls 122 and 123. For example, the rods 116, the cross brace 140, and the flanges 142 may be positioned relative to the walls 122 and 123 (e.g., the flanges 142 may each abut an associated wall 122, 123) to prevent displacement of the header assembly 111.

The cross brace 140 may further include holes 144 formed therein, and the rods 116 and attachment hardware 135 may extend through the holes 144. Nuts 137 may optionally be threaded on the rods 116 above the cross brace 140. Such nuts 137 may be located at a selected vertical location in order to position the cross brace 140, and other components of the movable partition system 100 (see FIG. 2), at a preselected and determined vertical height and in a desirable orientation (e.g., level at a height that enables a movable partition 102 to extend from floor to ceiling). In such an embodiment, the cross brace 140 may be sandwiched between the nuts 137 above the cross brace 140 and the washers 139 and nuts 137 below the cross brace 140.

Figure 8:
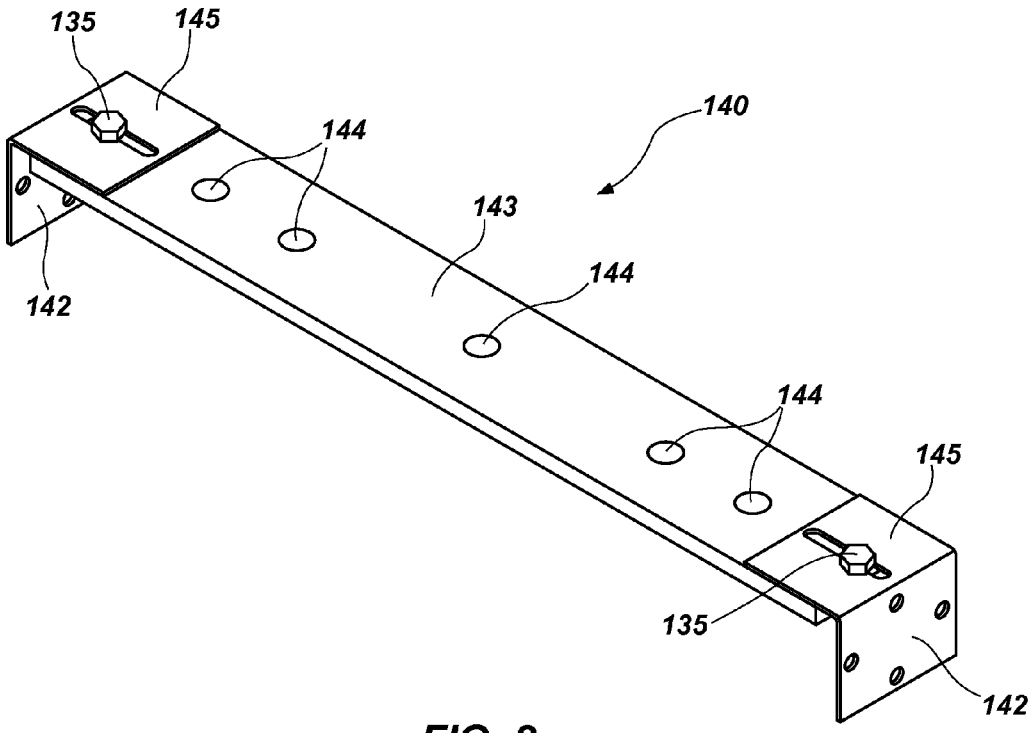
FIG. 8 is a perspective view of a cross brace for the header assembly of FIG. 3.
Figure 9:
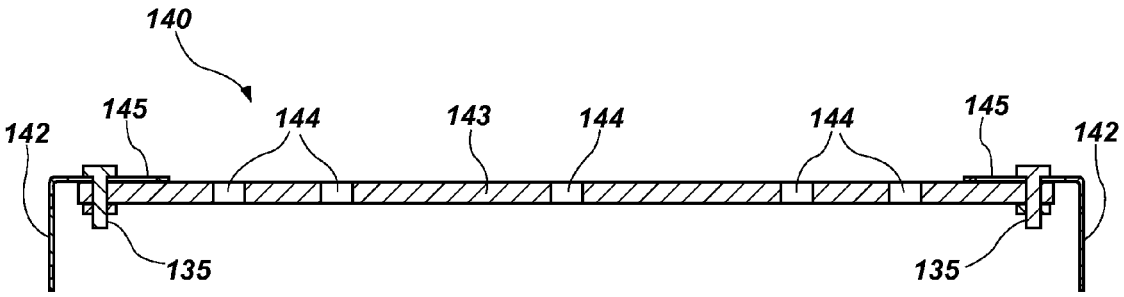
FIG. 9 is a cross-sectional view of the cross brace of FIG. 8.

The cross brace 140 is shown in further detail in FIGS. 8 and 9. The cross brace 140 may comprise a lateral restraint 143. The holes 144 may be formed in the lateral restraint 143, and the body of the lateral restraint 143 may prevent the rods 116 (see FIG. 3) from laterally displacing to any significant degree as the rods 116 press against the walls of the holes 144 defined by the lateral restraint 143. The flanges 142 at the lateral ends of the lateral restraint 143 may comprise "L" shaped brackets 145 attached to the lateral restraint 143, which may be laterally adjustable. For example, slots in the brackets 145 may enable the brackets 145 to slide laterally outward from the lateral restraint 143 to abut the flanges 142 against the walls 122 and 123. Attachment hardware 135 may secure the brackets 145 to the lateral restraint 143, and may fix the lateral length of the cross brace 140 when tightened such that the brackets 145 are not laterally slidable until the attachment hardware 135 is loosened.

Returning to FIG. 3, the header assembly 111 may include a header pan 152 that extends across the header space 112 between the first wall 122 and the second wall 123 to form at least a portion of a barrier. The header pan 152 may at least substantially seal off the header space 112 alone or in combination with other components of the header assembly 111, when present. In some embodiments, the header pan 152 may form at least a portion of a fire-resistant barrier. The header pan 152 may comprise at least two members 151A and 151B (e.g., sheet metal members) that define opposing lateral portions of the header pan 152 and jointly form a structure (e.g., a metal pan) that extends between the first wall 122 and the second wall 123 over the movable partition 102 (FIG. 2). For example, the header pan 152 may be formed by at least two members (e.g., two separate members such as a first discrete member 151A and a second discrete member 151B). In some embodiments, the first and second members 151A and 151B may each be abutted to a portion of the header assembly 111 to form the header pan 152. For example, the first and second members 151A and 151B may each be abutted to a portion of the overhead track 120. In some embodiments, the first and second members 151A and 151B may be abutted to one another. For example, the first member 151A may be abutted to (e.g., overlapped with) second member 151B to form the header pan 152. In other embodiments, e.g., as discussed below with reference to FIG. 7, a gap 148 may remain between the first and second members 151A and 151B.

In some embodiments, the header pan 152 may be sandwiched between the overhead track 120 below the header pan 152 and the structural elements 136 above the header pan 152. The header pan 152 may be secured to the overhead track 120 and the structural elements 136 using, for example, the attachment hardware 135 extending from the first and second channels 130 and 132 of the overhead track 120, through the header pan 152, into the channels 138 of the structural elements 136.

In some embodiments, the header pan 152 may be formed to provide a channel 154 located, for example, in a laterally central portion of the header pan 152, such that the header pan 152 extends over or at least partially around the overhead track 120. The overhead track 120 may be at least partially received within the channel 154 jointly formed by the first and second members 151A, 151B defining opposing lateral portions of the header pan 152. While the header pan 152 shown in FIG. 3 includes a channel 154, the header pan 152 may not include a channel in other embodiments. For example, the header pan may be substantially flat or the header pan may not extend partially around the overhead track 120, but rather, may simply abut against and be coupled to an upper surface of the overhead track 120. The header pan 152 also may comprise flanges for abutting against the first and second walls 122 and 123, like the flanges 142 of the cross brace 140 previously described herein in some embodiments. In other words, the header pan 152 and molding members 146 and 147, discussed below, may be integrally formed.

In some embodiments, the first and second members 151A and 151B may be formed to extend to and abut with (e.g., be attached to) an associated wall 122, 123.

In other embodiments, the first and second members 151A and 151B may be formed to not extend to the associated wall 122, 123. In other words, the lateral distance that the first and second members 151A and 151B extend from either side of the overhead track 120 is less than a lateral distance between the side of the overhead track 120 and the associated wall 122, 123. In such an embodiment, the header assembly 111 may further include a first molding member 146 extending from the first member 151A of the header pan 152 to the first wall 122, and a second molding member 147 extending from a second member 151B of the header pan 152 to the second wall 123. While the embodiment shown and described in FIG. 3 includes the first and second molding members 146 and 147, the header assembly 111 may comprise one or a plurality of such molding members. As shown in FIG. 3, the first and second molding members 146 and 147 may abut against, for example, a surface of the first and second walls 122 and 123, respectively, defining the header space 112. The first and second molding members 146 and 147 may be laterally adjustable with respect to the header pan 152. For example, the first and second molding members 146 and 147 may slide laterally outward from the header pan 152 to which they are connected to abut surfaces of the first and second molding members 146 and 147 against the opposing walls 122 and 123 of the adjoining structure of the header structure 126. The first and second molding members 146 and 147 may be attached to the first and second walls 122 and 123, respectively, in some embodiments. In other embodiments, the first and second molding members 146 and 147 may abut the first and second walls 122 and 123, respectively, without physically being attached to the first and second walls 122 and 123. In such an embodiment, a structural barrier (which may comprise a fire barrier) is formed by the various components of the header assembly 111.

Figure 10:
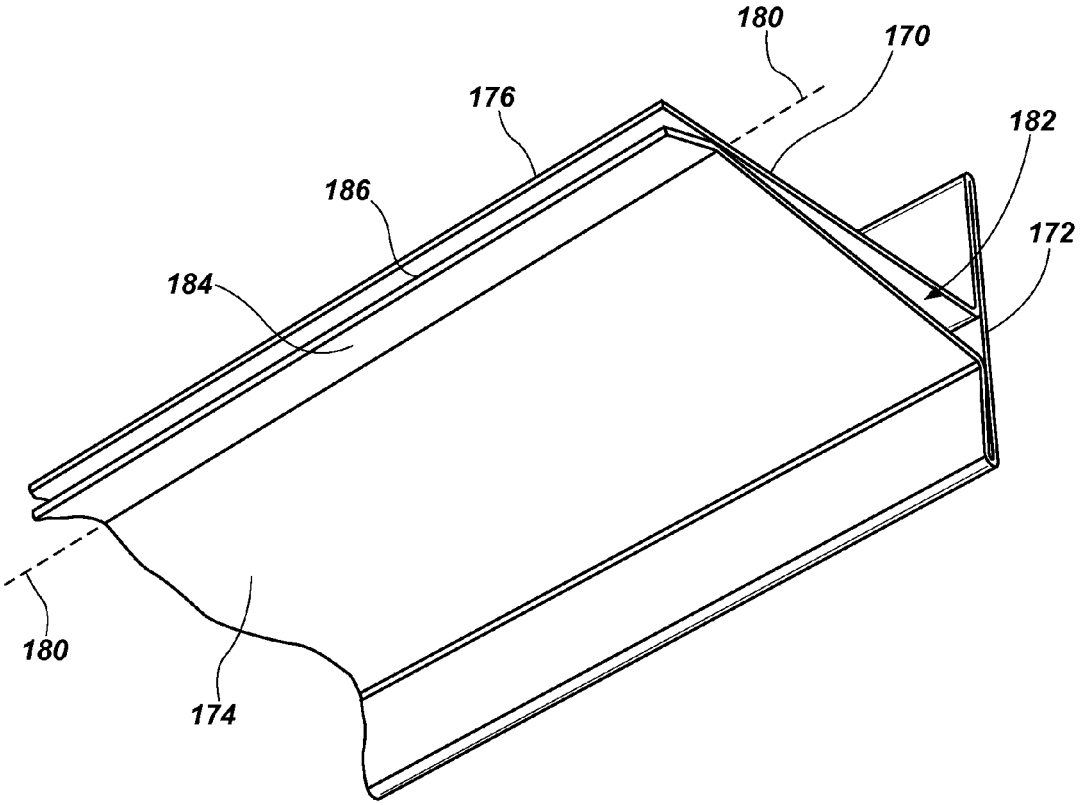
FIG. 10 is a partial cut-away perspective view of a molding member for the header assembly shown in FIG. 3.
Figure 11:
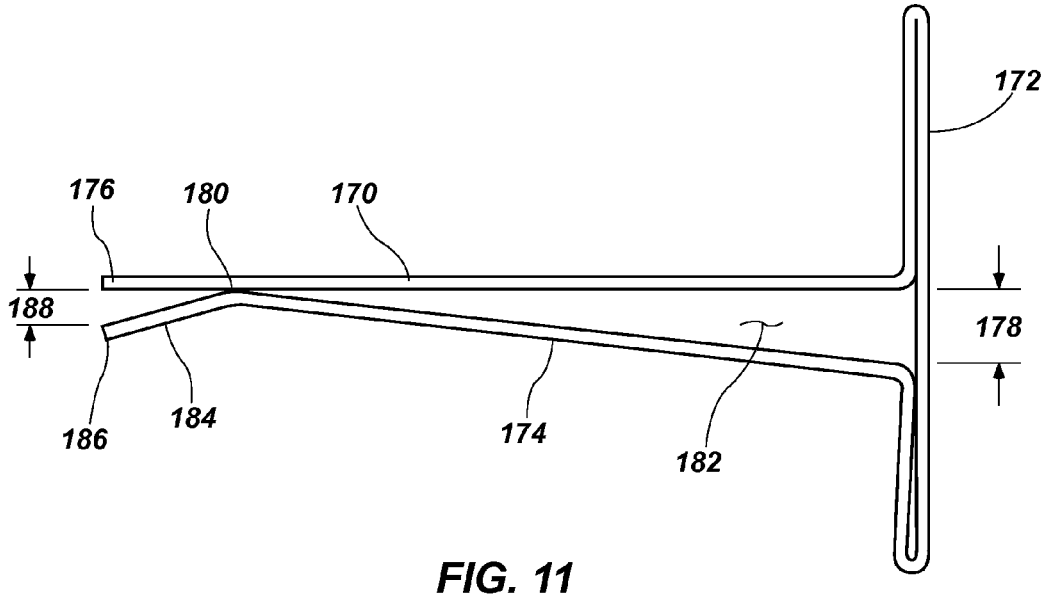
FIG. 11 is a cross-sectional view of the molding member of FIG. 10.

The first molding member 146 is shown in further detail in FIGS. 10 and 11. It is noted that while the first molding member 146 is shown in detail in FIGS. 10 and 11, the second molding member 147 may be identical to the first molding member 146. Such molding member 146 and 147 may comprise molding members such as those disclosed in U.S. patent application Ser. No. 13/183,250, filed Jul. 14, 2011, now U.S. Pat. No. 9,145,723, issued Sep. 29, 2015 to Garrett et al., the disclosure of which is incorporated herein in its entirety by this reference. The molding member 146 may include several regions or portions including an at least substantially flat base 170, an at least substantially flat back 172, and an at least substantially flat lever 174, each of which may comprise integral portions of a unitary structure in some embodiments. In other embodiments, at least one of the base 170, the back 172, and the lever 174 may comprise a discrete structure attached to others of the base 170, the back 172, and the lever 174. The base 170 may extend laterally outward to an end 176 of the base 170 configured for positioning proximate the header pan 152 (see FIG. 3). The back 172 may be oriented at least substantially perpendicular to the base 170 and may be positioned opposite the end 176 of the base 170 opposing the back 172. The lever 174 may extend from the back 172 toward the base 170 at an oblique angle relative to the base 170, leaving a first distance 178 between the lever 174 and the base 170 proximate the back 172, in some embodiments. The lever 174 may be configured to contact the base 170 along a line of contact 180 proximate the end 176 of the base 170 opposing the back 172. In other embodiments, the lever 174 may extend from the back 172 at least substantially parallel to the base 170. In either case, the molding member 146 may have an overall shape approximating a capital letter "T" when viewed from a longitudinal end in such embodiments.

One or more internal surfaces of the molding member 146 may define a recess 182 (e.g., a generally triangular recess). For example, internal surfaces of the base 170, the back 172, and the lever 174 may define the recess 182. The recess 182 may be configured to receive a portion of the header pan 152 (see FIG. 3). For example, an edge portion 155 (see FIG. 3) at a laterally outermost portion of the first member 151A may be received into the recess 182 of the molding member 146 to slidably connect the molding member 146 to the header pan 152. The molding member 146 may be laterally adjustable with respect to the header pan 152 (see FIG. 3) because the edge portion 155 of the header pan 152 is sandwiched between the base 170 and the lever 174, which may elastically deform (i.e., bend without permanent deformation) as the edge portion 155 is inserted into the recess 182. The first distance 178 between the lever 174 proximate the back 172 and the base 170 may be any distance sufficient to enable insertion of the edge portion 155 (see FIG. 3) into the recess 182. Accordingly, the first distance 178 may be greater than a thickness of the first and second members 151A and 151B of the header pan 152. By way of example and not limitation, the first distance 178 may be between about 0.05 in (1.27 mm) to about 0.2 in (5.08 mm).

The molding member 146 may also include a lip 184 between an end 186 of the lever 174 laterally opposing the back 172 and the line of contact 180 between the base 170 and the lever 174. The lip 184 may extend from the line of contact 180 between the base 170 and the lever 174 away from the base 170 at an oblique angle such that the ends 176 and 178 of the base 170 and the lever 174, respectively, are separated by a second distance 188. The second distance 188 may be provided to improve the ease of insertion of the edge portion 155 of the header pan 152 (see FIG. 3) between the ends 176 and 178 of the base 170 and the lever 174, respectively. Accordingly, the second distance 188 may be greater than a thickness of the first and second members 151A and 151B of the header pan 152. By way of example and not limitation, the second distance 188 may be between about 0.05 inch (1.27 mm) to about 0.2 inch (5.08 mm).

Figure 4:
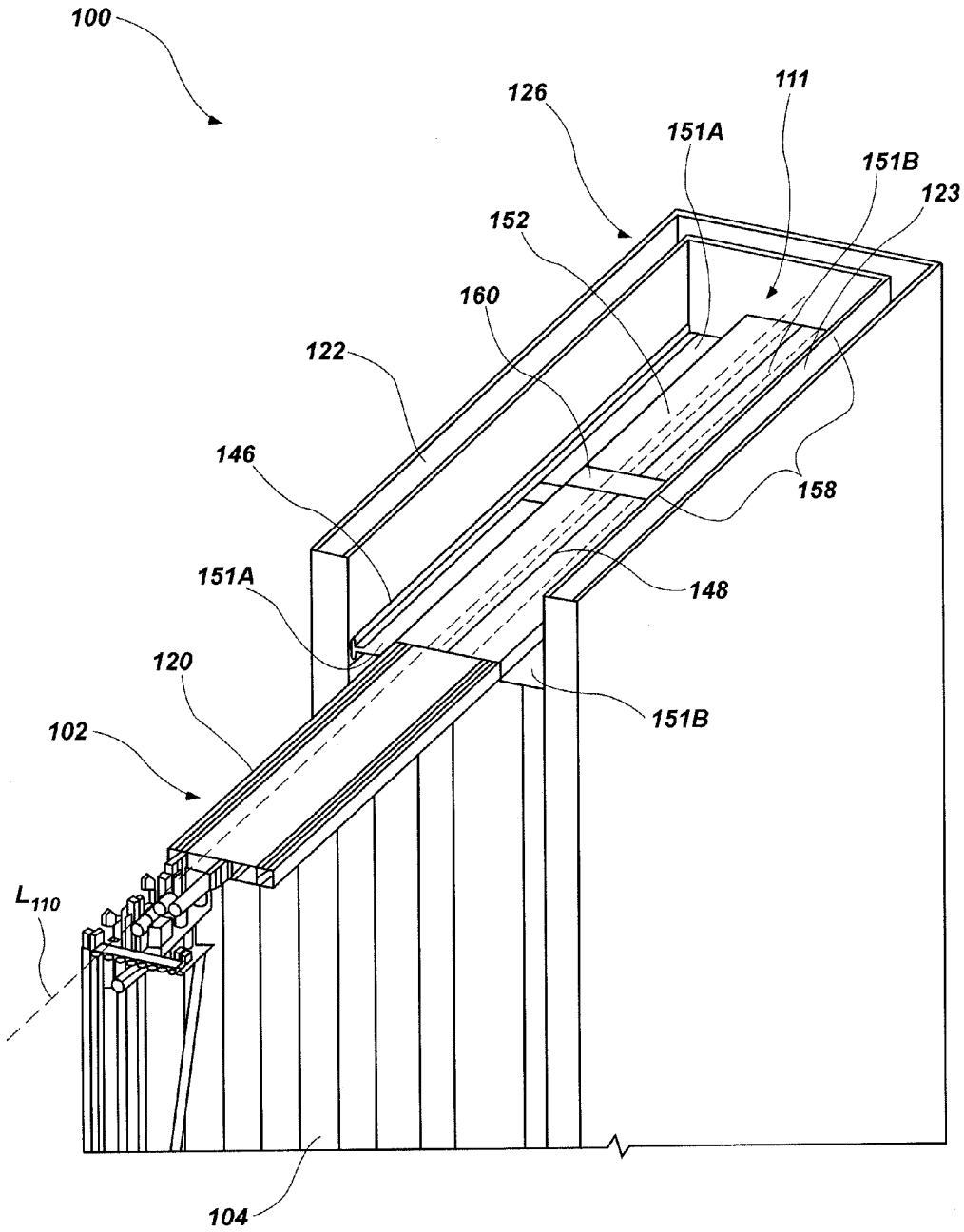
FIG. 4 is a simplified perspective view of the movable partition system of FIGS. 2 and 3 with various components and sections stripped away for the sake of simplicity.

With reference to FIG. 4, a simplified perspective view of the movable partition system of FIGS. 2 and 3 with various components and sections stripped away for the sake of simplicity is shown. The header pan 152 may extend longitudinally along at least a portion of the overhead track 120. Further, the header pan 152 may also extend laterally from the overhead track 120 to the first and second molding members 146 and 147. By way of example and not limitation, the header assembly 111 may have a longitudinal axis $L_{110}$. The longitudinal axis $L_{110}$ may be located centrally between the first and second walls 122 and 123 of the adjoining header structure 126 and may extend parallel to a direction in which the movable partition 102 is extendable for an entire span of the movable partition system 100.

In some embodiments, the header pan 152 may include a plurality of longitudinal header pan sections 158, which may extend for the entire longitudinal span of the movable partition system 100 when assembled. Each header pan section 158 and the track 120 may extend at least substantially parallel to the longitudinal axis $L_{110}$ of the header assembly 111 for at least a portion of the longitudinal span of the movable partition system 100. Each header pan section 158 may comprise at least two members (e.g., members 151A and 151B) defining opposing lateral portions of the header pan section 158 and may be contiguous with an adjoining header pan section 158 or to adjoining header pan sections 158 because of at least one header pan joint member 160. The header pan joint members 160 may be used to cover joints between longitudinal ends of the header pan sections 158. The header pan joint member 160 may be attached to adjacent longitudinal ends of adjoining header pan sections 158 to form a contiguous structure. For example, the adjacent longitudinal ends of adjoining header pan sections 158 and the header pan joint member 160 may be mutually sandwiched between the track 120 and the structural elements 136 (see FIG. 3) and secured in place by attachment hardware 135 extending through the track 120, the adjacent longitudinal ends of adjoining header pan sections 158, and the header pan joint member 160. To ensure that the attachment hardware 135 (see FIG. 3) extends through both header pan sections 158, there may be some longitudinal overlap between the ends of the header pan sections 158. Alternatively, the header pan joint member 160 may be secured to longitudinally adjacent header pan sections 158 by adhesives, crimping, or welding to form the contiguous header pan 152 structure. In other embodiments, the header pan 152 may comprise at least two members 151 (e.g., members 151A and 151B) that extend along the longitudinal axis $L_{110}$ of the header assembly 111 for the entire longitudinal span of the movable partition system 100 and define opposing lateral portions of the header pan 152.

Figure 6:
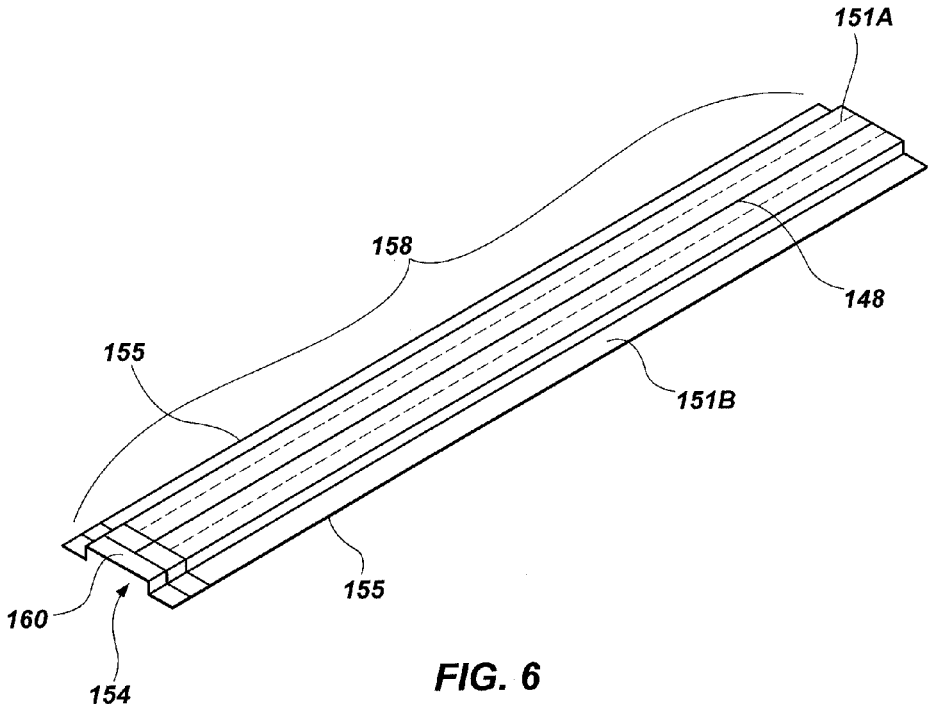
FIG. 6 is a perspective view of a header pan.
Figure 7:
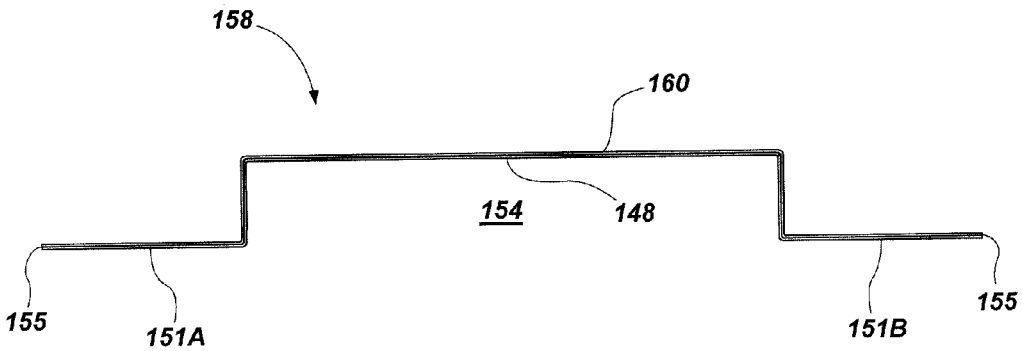
FIG. 7 is a cross-sectional view of the header pan section of FIG. 6.

A header pan section 158 of the header pan 152 is shown in FIGS. 6 and 7. The header pan joint member 160 may conform to the assembled header pan section 158. For example, in embodiments where the first and second members 151A and 151B of the header pan section 158 jointly define a channel 154 configured to receive at least a portion of a track 120 (see FIG. 4), the header pan joint member 160 may similarly define a channel. Each member 151A and 151B may comprise a sheet of material (e.g., fire resistant material) extending laterally inward at the edge portions 155, extending upward to define a depth of the channel 154, and extending laterally inward over the channel 154 toward the other member 151A or 151B mutually defining the channel 154. The header pan joint member 160 may comprise a unitary structure extending laterally inward along the edge portions 155 of the first and second members 151A and 151B, extending upward along the channel 154, and laterally inward over the channel 154. The header pan joint member 160 may be configured to be positioned above the members 151A and 151B in some embodiments. In other embodiments, the header pan joint member 160 may be configured for positioning below the member 151A and 151B (e.g., by being received into the channel 154). In embodiments where the first and second member 151A and 151B of the header pan section 158 do not define a channel 154 into which at least a portion of the track 120 (see FIG. 4) is receivable, the header pan joint member 160 may comprise a flat sheet of material or may otherwise conform to the contour of the header pan section 158. In some embodiments, a gap 148 may remain between the laterally adjacent members 151A and 151B in some embodiments. For example, a gap 148 of between 1/32 in (0.79 mm) and 1/2 in (12.7 mm) may be defined by the laterally adjacent members 151A and 151B of the header pan 152. In other embodiments, the laterally adjacent members 151A and 151B may abut one another such that no gap is present between the members 151A and 151B along all or a portion of the header pan 152.

In embodiments where the movable partition 102 is employed as a fire barrier, the header pan 152, the overhead track 120, and the first and second molding members 146 and 147 may comprise a fire-resistant material such as steel, composite materials, or any material capable of exhibiting fire-resistant qualities over a set period of time or any material treated with a fire retardant coating. As the various components of the header assembly 111 may be formed from a fire-resistant material such as steel, embodiments of header assemblies 111 of the present disclosure may be substantially free of gypsum board and other gypsum board-like materials typically used in fire rated walls and barriers.

Figure 5:
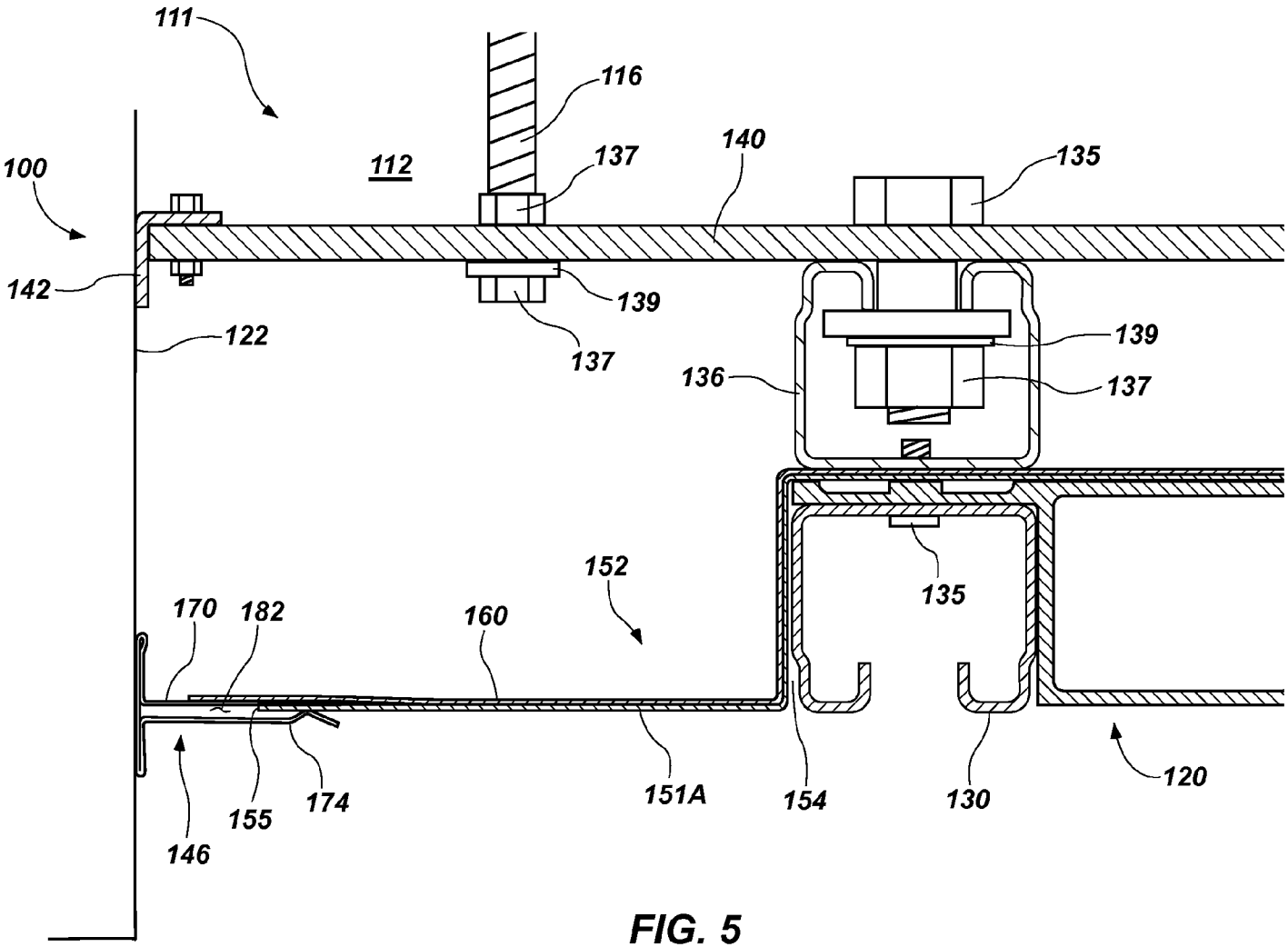
FIG. 5 is an enlarged cross-sectional view of a portion of the header assembly of FIG. 3.

With reference to FIG. 5, an enlarged cross-sectional view of a portion of the header assembly 111 of FIG. 3 is shown. When installing the movable partition system 100, the first and second members 151A and 151B defining opposing lateral portions of a header pan 152 may be provided to jointly form the header pan 152. The first and second members 151A and 151B may be temporarily suspended from the structural elements 136, which may have been previously suspended from the overhead support member 118 (see FIG. 3). Providing the first and second members 151A and 151B may comprise providing a plurality of longitudinal header pan sections 158 (see FIG. 4) in some embodiments. Each header pan section 158 may comprise two members 151A and 151B defining the opposing lateral portions of the header pan sections. Longitudinally adjoining header pan sections 158 may abut against one another to form a contiguous structure. Header pan joint members 160 may cover seams between longitudinally adjacent header pan sections 158. In other embodiments, the first and second members 151A and 151B of the header pan 152 may extend along an entire longitudinal span of the header space 112 in which they are disposed. A gap 148 (see FIGS. 6 and 7) may be defined between the laterally adjacent first and second members 151A and 151B of the header pan 152 along some or all of the longitudinal length of the header pan 152 in some embodiments. In other embodiments, the first and second members 151A and 151B may abut against one another or overlap with one another such that there is no gap extending longitudinally along the header pan 152.

The overhead track 120 may abut against the header pan 152. The overhead track 120 may be received into a channel 154 jointly defined by the first and second members 151A and 151B of the header pan 152 such that a lower surface of the track 152 is flush with the laterally extending edge portions 155 of the header pan 152 in some embodiments. In other embodiments, the overhead track 120 may protrude beyond or be recessed below the edge portions 155 of the header pan 152. In still other embodiments, an upper surface of the overhead track 120 may simply abut against a lower surface of the header pan 152 not positioned in such a channel 154. In embodiments where a gap 148 extends longitudinally between laterally adjacent members 151A and 151B of the header pan 152, the upper surface of the overhead track 120 may cover the gap 148 such that the gap 148 is concealed by the track 120. In other words, the combination of the first and second members 151A and 151B and the overhead track 120 may form a barrier (e.g., a fire barrier).

The overhead track 120 and the header pan 152 may be secured to one another. Attachment hardware 135 may extend through holes in the track 120, holes in the header pan 152 (e.g., in the members 151A and 151B of adjoining header pan sections 158 and in the header pan joint member 160), and holes in the structural elements 136 to secure the overhead track 120 and the header pan 152 to one another and to suspend the overhead track 120 and the header pan 152 from the overhead support structure 118 (see FIG. 3) in some embodiments. In other embodiments, the overhead track 120, the header pan 152, and the structural elements 136 may be secured to one another using, for example, an adhesive, a weld, or a crimp.

The header assembly 111 may contact laterally opposing walls 122 and 123 to provide a barrier to fire. As discussed above, in some embodiments, a portion of the first and second member 151A and 151B may contact one of the laterally opposing walls 122 and 123. In other embodiments, the first and second member 151A and 151B may not contact the laterally opposing walls 122 and 123 and may be spaced a distance from the wall 122 and 123. In such embodiments, the edge portions 155 of the first and second members 151A and 151B may be inserted into recesses 182 defined between the base 170 and the lever 174 of the first and second molding members 146 and 147, respectively. The edge portions 155 of the first and second members 151A and 151B may be sandwiched between the base 170 and the lever 174 because of the natural resistance of the lever 174 and the base 170 to deformation as the edge portions 155 displace the base 170 and the lever 174 from their natural dispositions. In other words, the base 170 and the lever 174 may bend away from one another as the edge portions 155 are inserted into the recess 182, and may press against the edge portions 155 because of their natural spring-like resilience. In embodiments where the header pan 152 includes a plurality of header pan sections 158 (see FIG. 4), the base 170 may optionally be sandwiched between the header pan joint member 160 and the members 151A and 151B of the header pan section 158 to better secure the molding members 146 and 147 to the members 151A and 151B. After connection to the edge portions 155 of the header pan 152, the first and second molding members 146 and 147 may be displaced laterally outward from the overhead track 120 to abut against the first and second walls 122 and 123 of the adjoining structure. The molding members 146 and 147 may optionally be secured to the walls 122 and 123 they respectively abut. For example, the molding members 146 and 147 may be screwed, bolted, adhered, or otherwise connected to the walls 122 and 123 they abut. In other embodiments, the edge portions 155 of the header pan 152 may directly abut the first and second walls 122 and 123 of the adjoining structure.

A movable partition 102 (see FIG. 4) may be suspended from the track 120. For example, a movable partition system 100 including a header pan 152 having first and second members 151A and 151B defining opposing lateral portions of the header pan 152 may be installed. Such a movable partition system 100 may provide a barrier to heat, smoke, flame, light, noise, human access, or other things that are not desired to pass from one side of the movable partition system 100 to the other.

In view of the above, embodiments of the present disclosure may be particularly useful in providing a header assembly for a movable partition. Use of a simplified barrier such as the first and second members of the header pan to provide a header assembly may allow for a simplified installation of a movable partition. For example, the first and second members may be easier and safer to handle, lift, and secure within the header assembly because of their decreased size and weight as compared to prior header pans. In addition, the first and second members may be simpler to make and easier to package and transport than prior header pans. Use of the cross brace may allow the header assembly to be aligned and secured within a header structure. The use of the header assembly allows for parts of the movable partition system to be pre-prepared before installation and reduces the need to customize parts and materials such as layers of plywood and gypsum board to fit each individual installation. Moreover, in applications where the movable partition is employed as a fire barrier, the header assembly provides an adaptable fire-resistant barrier.

While the present disclosure has been described herein with respect to certain example embodiments, those of ordinary skill in the art will recognize and appreciate that it is not so limited. Rather, many additions, deletions, and modifications to the embodiments described herein may be made without departing from the scope of the disclosure as hereinafter claimed, including legal equivalents. In addition, features from one embodiment may be combined with features of another embodiment while still being encompassed within the scope of the disclosure as contemplated by the inventor.

What is claimed is:

1. A movable partition including a header assembly comprising:

an overhead track;

a movable partition comprising at least one structure of hingedly connected panels suspended from the overhead track;

a header pan abutting against and secured to the overhead track, the header pan being positioned vertically above the overhead track, the header pan comprising at least two separately formed and discrete header pan members defining opposing lateral portions of the header pan, wherein the header pan forms a portion of a fire-resistant barrier extending from a wall of an adjoining structure to an opposing wall of the adjoining structure;

a first molding member abutting against the wall of the adjoining structure and comprising a first recess receiving at least an edge portion of a first header pan member of the at least two header pan members, the first molding member being adjustable laterally relative to the header pan; and a second molding member abutting against the opposing wall of the adjoining structure and comprising a second recess receiving at least an edge portion of a second header pan member of the at least two header pan members, the second molding member being adjustable laterally relative to the header pan.

2. The movable partition header of claim 1, wherein each of the first molding member and the second molding member comprises:

an at least substantially flat base extending laterally outward to an end of the base, the base being positioned proximate the header pan;

an at least substantially flat back oriented at least substantially perpendicular to the base and positioned opposite the end of the base; and an at least substantially flat lever extending from the back toward the base at an oblique angle relative to the base, leaving a first distance between the lever and the base proximate the back and defining the corresponding recess between the lever and the base.

3. The movable partition of claim 1, wherein the first header pan member and the second header pan member form a gap between the edge portion of the first header pan member and the wall of the adjoining structure and another gap between the edge portion of the second header pan member and the opposing wall of the adjoining structure.

4. The movable partition of claim 1, wherein the first header pan member abuts the second header pan member to form the header pan.

5. The movable partition of claim 4, wherein the first header pan member of the at least two header pan members overlaps the second header pan member of the at least two header pan members to form the header pan.

6. The movable partition of claim 1, further comprising:

at least two structural elements, each structural element secured to a header pan member of the at least two header pan members on a side opposing the overhead track; and at least two fastener elements suspending the at least two structural elements from an overhead support member of the adjoining structure.

7. The movable partition of claim 6, further comprising at least one cross brace suspended from the at least two fastener elements and attached to the at least two structural elements, the at least one cross brace extending from the wall of the adjoining structure to the opposing wall of the adjoining structure.

8. The movable partition of claim 1, wherein the at least two header pan members of the header pan jointly define a channel at a laterally central portion of the header pan and wherein at least a portion of the overhead track is received in the channel.

9. The movable partition of claim 8, wherein the at least two header pan members form a gap at a central portion of the channel.

10. The movable partition of claim 1, wherein the overhead track covers the gap formed by the at least two header pan members and wherein the overhead track and the header pan together form the fire-resistant barrier.

11. The movable partition of claim 1, wherein the header pan comprises a plurality of header pan sections, each header pan section comprising at least two header pan members defining opposing lateral portions of each header pan section, and at least one header pan joint, the at least one header pan joint abutting longitudinally adjoining header pan sections of the plurality of header pan sections to form a contiguous structure.

12. A method of installing a movable partition, comprising:

forming a header pan comprising combining a first header pan member and a second header pan member to jointly form the header pan, the second header pan member being separately formed and discrete from the first header pan member;

coupling an overhead track from to an adjoining structure;

positioning the header pan laterally across a header space between a wall of the adjoining structure and an opposing wall of the adjoining structure, the header pan forming a portion of a fire-resistant barrier extending from a wall of an adjoining structure to an opposing wall of the adjoining structure, wherein positioning comprises:

abutting the overhead track with a first lateral portion of the header pan extending from the overhead track toward the wall of the adjoining structure, the header pan positioned vertically above the overhead track; and abutting the overhead track with a second lateral portion of the header pan extending from the overhead track toward the opposing wall of the adjoining structure, the header pan positioned vertically above the overhead track;

inserting an edge portion of the first header pan member into a first recess of a first molding member, thereby connecting the first header pan member to the first molding member;

abutting the first molding member against the wall of the adjoining structure;

inserting an edge portion of the second header pan member into a second recess of a second molding member, thereby connecting the second header pan member to the second molding member; and abutting the second molding member against the opposing wall of the adjoining structure; and suspending a movable partition comprising at least one structure of hingedly connected panels from the overhead track.

13. The method of claim 12, wherein inserting the edge portion of each of the first molding member and the second molding member into a respective one of the first and second molding members comprises inserting the edge portion of each of the first molding member and the second molding member between an at least substantially flat base extending laterally outward to an end of the base configured for positioning proximate the header pan and an at least substantially flat lever extending from the back toward the base at an oblique angle relative to the base, the base and the lever being connected to one another by an at least substantially flat back oriented at least substantially perpendicular to the base and positioned opposite the end of the base, the base, the lever, and the back cooperatively defining the corresponding recess.

14. The method of claim 12, further comprising securing the first molding member and second molding member to the wall and the opposing wall, respectively, of the adjoining structure.

15. The method of claim 12, wherein abutting the overhead track with the first lateral portion and the second lateral portion of the header pan comprises inserting at least a portion of the overhead track into a channel jointly defined by the first lateral portion and the second lateral portion of the header pan.

16. The method of claim 12, wherein forming a header pan further comprises positioning a plurality of longitudinally extending header pan sections each comprising a first lateral portion and a second lateral portion along a length of the overhead track.

17. The method of claim 16, further comprising covering at least one seam formed between longitudinally adjoining header pan sections with at least one header pan joint member to form a contiguous structure.

* * * * *